US006766606B2

(12) United States Patent
Fluhr et al.

(10) Patent No.: US 6,766,606 B2
(45) Date of Patent: Jul. 27, 2004

(54) HAND-HELD FIREARM WITH A COMBINATION LOCK

(75) Inventors: Norbert Fluhr, Oberndorf (DE); Johannes-August Bantle, Bösingen (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 0 days.

(21) Appl. No.: 10/177,543

(22) Filed: Jun. 21, 2002

(65) Prior Publication Data

US 2002/0174585 A1 Nov. 28, 2002

Related U.S. Application Data

(63) Continuation of application No. PCT/EP01/12252, filed on Oct. 23, 2001.

(30) Foreign Application Priority Data

Oct. 23, 2000 (DE) ..... 100 52 466

(51) Int. Cl.[7] ..... F41A 17/00
(52) U.S. Cl. ..... 42/70.06; 42/70.07; 42/70.11
(58) Field of Search ..... 72/70.06, 70.07, 72/70.11

(56) References Cited

U.S. PATENT DOCUMENTS

| | | | | | |
|---|---|---|---|---|---|
| 2,453,683 | A | | 11/1948 | Caldow | 42/70 |
| 3,368,297 | A | * | 2/1968 | Lentz | 42/70.07 |
| 3,735,519 | A | | 5/1973 | Fox | 42/70 D |
| 4,014,123 | A | * | 3/1977 | Williams | 42/70.11 |
| 5,743,039 | A | | 4/1998 | Garrett | 42/70.11 |
| 5,832,647 | A | * | 11/1998 | Ling et al. | 42/70.07 |
| 5,930,930 | A | | 8/1999 | Howell | 42/70.11 |
| 5,946,841 | A | | 9/1999 | Roper | 42/70.11 |
| 5,987,796 | A | * | 11/1999 | Brooks | 42/70.11 |
| 6,125,568 | A | | 10/2000 | Granaroli | 42/70.11 |
| 6,212,812 | B1 | | 4/2001 | Aigner | 42/70.06 |
| 6,429,769 | B1 | * | 8/2002 | Fulgueira | 340/5.33 |
| 6,442,881 | B1 | * | 9/2002 | Kellerman | 42/70.11 |
| 6,474,011 | B1 | * | 11/2002 | Sato | 42/70.11 |
| 6,519,888 | B1 | * | 2/2003 | Oberst | 42/70.11 |
| 6,550,175 | B2 | * | 4/2003 | Parker | 42/70.07 |

FOREIGN PATENT DOCUMENTS

EP 0 973 004 A 1/2000

OTHER PUBLICATIONS

International Search Report in PCT/EP01/12252 dated Jan. 23, 2002.

* cited by examiner

*Primary Examiner*—Michael J. Carone
*Assistant Examiner*—M. Thomson
(74) *Attorney, Agent, or Firm*—Grossman & Flight, LLC

(57) ABSTRACT

A hand-held firearm with a combination lock with number dials rotatable around an axis is disclosed. The lock only permits movement of the bar triggering a shot if the lock is unlocked. The axis of the lock is positioned transversely to the longitudinal axis of the weapon. The combination of the lock is changeable.

18 Claims, 9 Drawing Sheets

HAND-HELD FIREARM WITH A COMBINATION LOCK

RELATED APPLICATION

This patent arises from a continuation application which claims priority under 35 U.S.C. § 120 from International Application No. PCT/EP01/12252, filed Oct. 23, 2001.

FIELD OF THE DISCLOSURE

This disclosure relates generally to firearms and, more particularly, to a handheld firearm with a combination lock.

BACKGROUND

All positional designations that are used in this patent relate to a weapon in the normal firing position, namely, with the barrel in a generally horizontal orientation, and are considered from the viewpoint of the person who is shooting the weapon (i.e., the shooter). If the shooter holds the weapon with his/her right hand, for example, then his/her index finger lies to the right, and thumb lies to the left of the weapon. The weapon is then pointing "forward" away from the shooter.

A hand-held firearm is known from U.S. Pat. No. 3,735,519. This publication depicts a conventional automatic firearm in which a combination lock with a vertical axis is positioned above and in front of the trigger, and closely behind the shaft of a magazine. This combination lock has three numeral bearing dials which are coaxial. The dials are positioned one above the other and are rotatable, such as is already known from a simple combination lock for briefcases, for example. A recess is located in the left side of the weapon casing. Sections of the three number dials are visible and can be rotated by means of a finger through this recess. In one specific and unchangeable, relative position of the three number dials (e.g., "123"), a lever is moveable to the rear. The lever remains set (i.e., immovable) in every other relative position of the number dials. This lever is connected with the trigger bar. The bar is, thus, movable when the lever is released, but is not movable when the lever is fixed. The lever, and, thus, the bar and the trigger as well, can only be moved if a certain number combination is set by means of the number dial. The weapon can, therefore, only be fired in this one position of the number dial.

When the weapon is uncocked, the shooter can very easily check whether the combination lock is blocked or open by pulling the trigger. If the trigger moves markedly to the rear upon pulling with the finger, then the combination lock is open and the weapon can be used. The combination lock can, however, also be blocked when the weapon is cocked (i.e., the hammer is located to the rear). If the shooter wants to ascertain whether the loaded weapon is ready to be fired or not when the weapon is cocked, then he/she must check the setting of the numbers on the combination lock. That is to say, if he/she were to pull on the trigger and the lock were open, then a shot would be fired. Such checking of the position of the numbers of the lock is not actually possible in darkness or in the event of a lack of time.

One older automatic firearm has a relatively great amount of free space available in the casing. In modern weapons, this no longer the case. A combination lock of the above described type cannot be accommodated, particularly in a modem self-loading pistol, without the pistol grip of the weapon being changed in a substantial and inconvenient manner.

It is also important for customers who want to purchase a weapon to like the weapon. This principle is applicable for private individuals as well as for military and law enforcement personnel who are entrusted with the procurement of new weapons. A safety device which disfigures the weapon is, therefore, an unusually great obstacle to sales and cannot, for that reason, be accepted.

Furthermore, safety devices should not be too clearly obvious. A lawbreaker or other opponent who seizes a weapon in a scuffle and wishes to use the weapon immediately should not, as much as possible, be aware of the safety lock.

On the other hand, the known safety lock with rotatable number dials discussed above has a whole series of advantages in comparison with all electronic safety devices. For example, it does not need a battery, and is, thus, still completely ready for use even after decades without any maintenance.

Safety locks with keys are also known. After the loss of the key, however, a weapon equipped and secured with such a lock is useless, at least for the moment.

There are also locks with several pushbutton keys which are to be punched in or depressed in order to release the weapon for firing. One such self-loading weapon is known from U.S. Pat. No. 5,946,841. This firearm is equipped with four pushbutton keys which are positioned, in a clearly visible manner, in the extension of a pistol grip under the slide support unit. Because there are only four buttons, there are only a total of 16 setting possibilities. Thus, a mischievous little boy could decode the lock combination within a few minutes.

It has also already been proposed to equip handguns with rotatable number dials. However, in these proposals the dials are positioned either in areas where they come into immediate contact with the hand holding the weapon during shooting (see U.S. Pat. No. 5,743,039) and can thus be accidentally adjusted in an undesirable manner, or else require a considerable widening of the pistol grip of the weapon (as can be inferred from U.S. Pat. No. 5,930,930).

Incidentally, the need to produce a weapon, particularly a handgun, which cannot be used if it falls into the wrong hands, at least in the short-term, has existed for decades. In particular, the case in which children unintentionally come upon a weapon and play around with it, often ends tragically. If, however, a burglar steals a weapon, for example, and a mechanic can then work on it in complete peace in a workshop, then it will undoubtedly become usable again in every case, regardless of the sophistication of the safety device.

DESCRIPTION OF THE PREFERRED EXAMPLES

Figure 1:
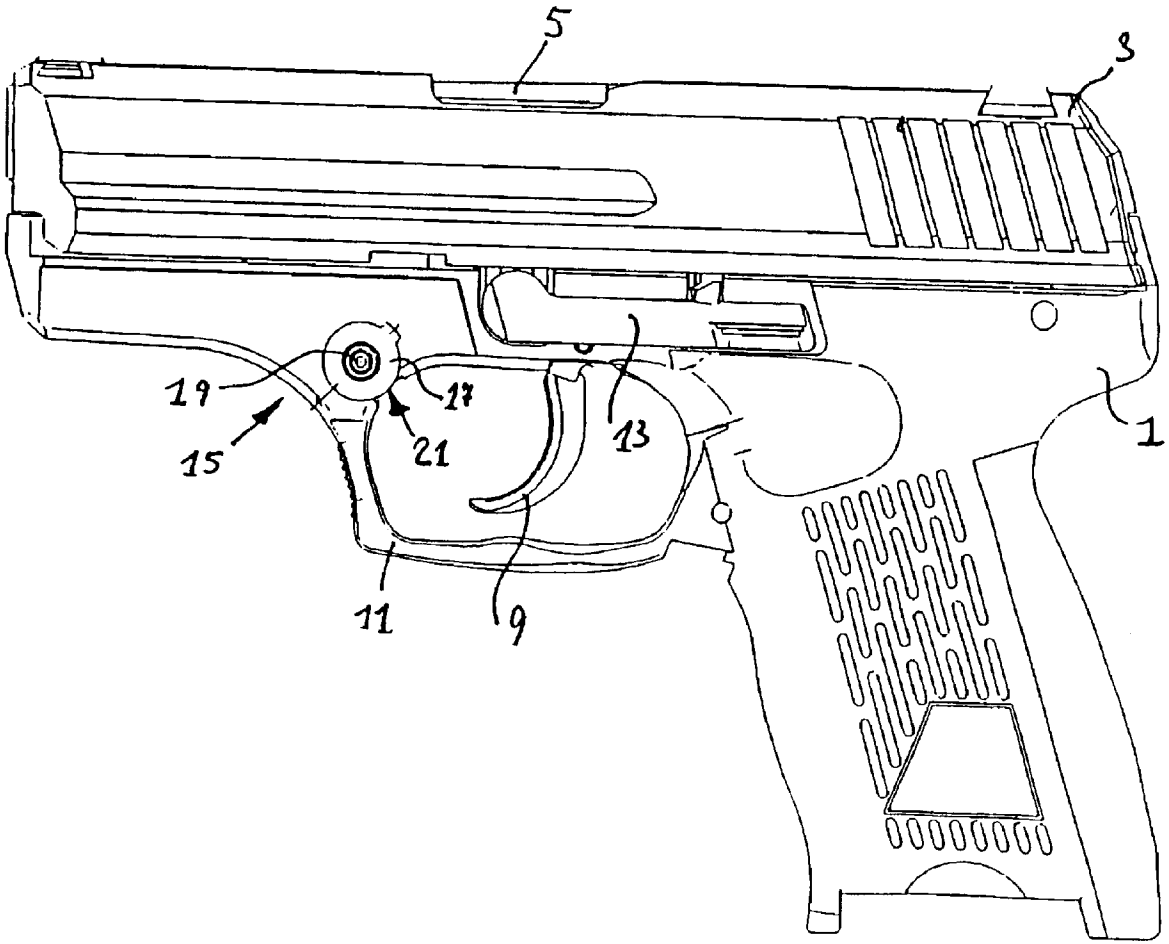
FIG. 1 is a left side view of an example firearm constructed in accordance with the teachings of the invention.
Figure 2:
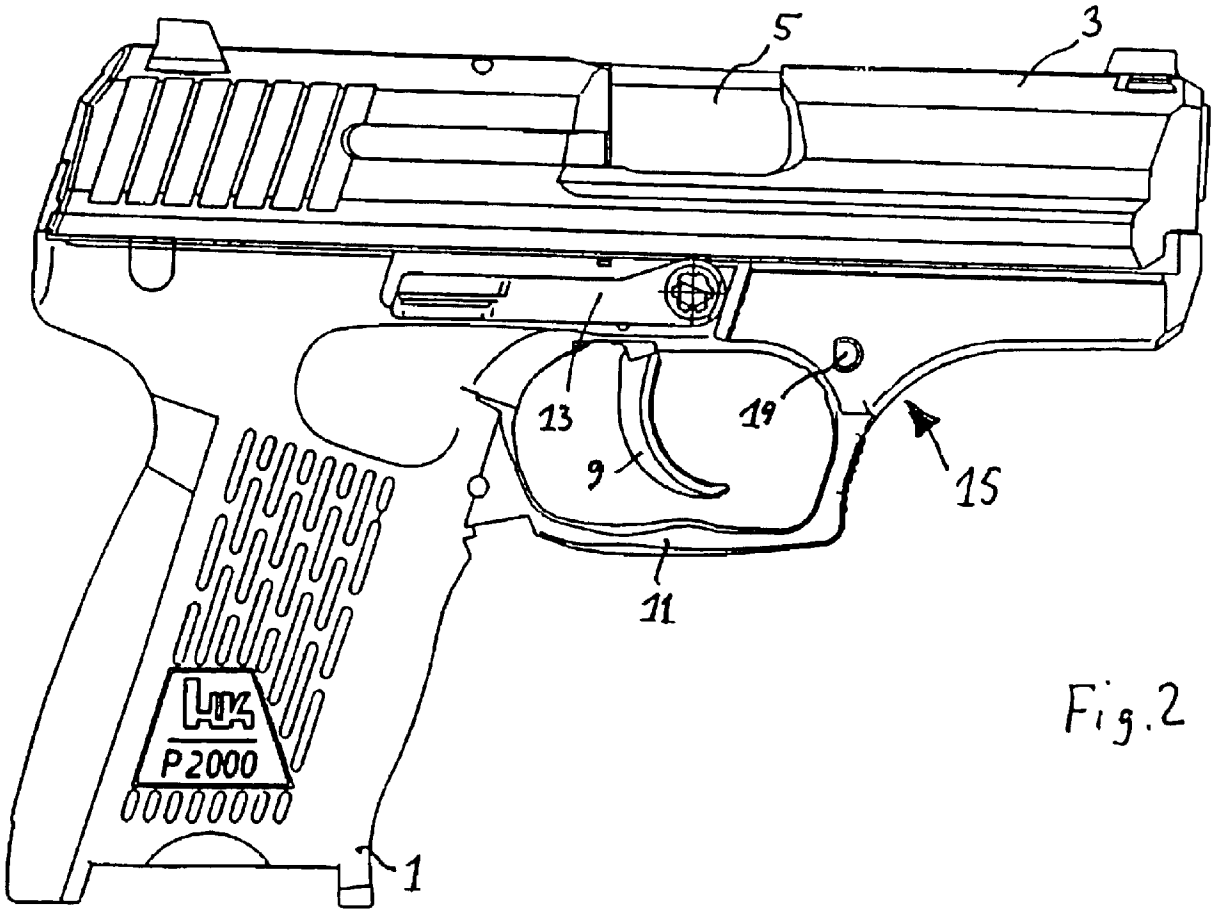
FIG. 2 is a right side view of the weapon of FIG. 1.
Figure 3:
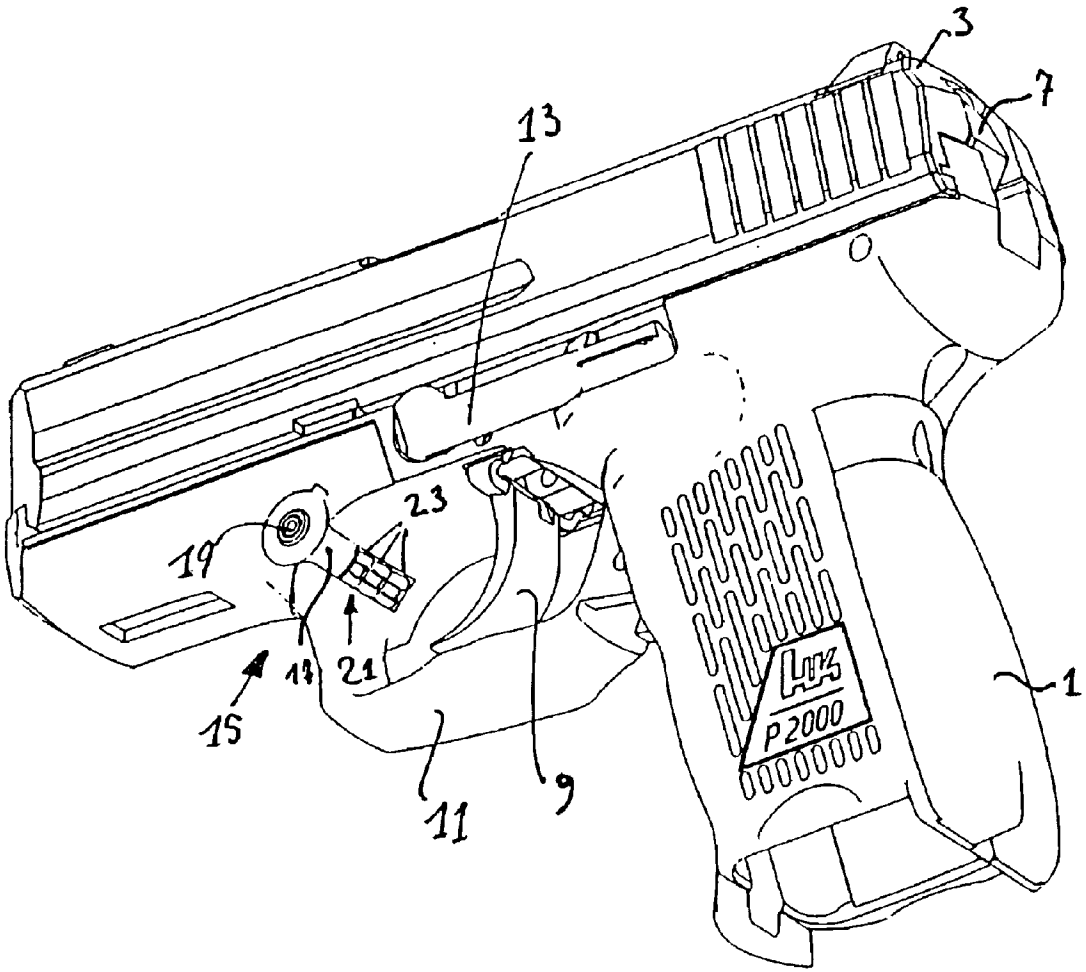
FIG. 3 is a perspective view of the weapon of FIGS. 1 and 2, viewed from the bottom, left and rear.

FIGS. 1 to 3 illustrate an example self-loading firearm constructed in accordance with the Colt-Browning principle. The illustrated firearm includes a pistol grip (1) made of plastic and reinforced by steel inlays. The firearm also includes a lock or slide support unit (3), and a barrel (5). A trigger guard (11) which, at its forward upper end, passes over into the pistol grip (1) by way of a transition (15), is formed as a single piece with the pistol grip (1). The pistol has a hammer (7) (see FIG. 3) and a trigger (9). In the safety-on condition of the weapon (FIGS. 1–3), the trigger (9) is in active connection with the hammer (7). That is to say, if the relaxed hammer (7) moves to the rear (i.e., toward the cocked position), then the trigger (9) must also move backwards and vice versa. Furthermore, a lock catching lever is provided with a penetrating shaft on each side of the pistol (for the comfortable operation by both right-handed and left-handed users). This construction assembly is designated as a whole by reference numeral (13).

The illustrated firearm includes an overall cylindrical combination lock (17) that proceeds transversely through the transition (15) in a horizontal orientation. This combination lock (17) has three coaxial numeral-beating dials (23). The transition (15) has an aperture (21) oriented towards the trigger (9). A combination set by the number dials (23) is visible and adjustable through the aperture (21). The combination lock (17) is formed as a pushbutton safety unit (19) and, thus, the lock (17) is movable along its axis.

The pushbutton safety unit (19) is visible on both sides of the pistol (see FIGS. 1–2). If the pushbutton safety unit (19) projects out of the left surface of the transition (15) (see FIGS. 1 and 7) and, seals in a flush manner with the right surface of the transition (15) (see FIGS. 2 and 7), then the weapon is secured against firing and the number dials (23) of the combination lock (17) can have any position that is desired. This state of the combination lock (17) is depicted in FIG. 7.

Figure 8:
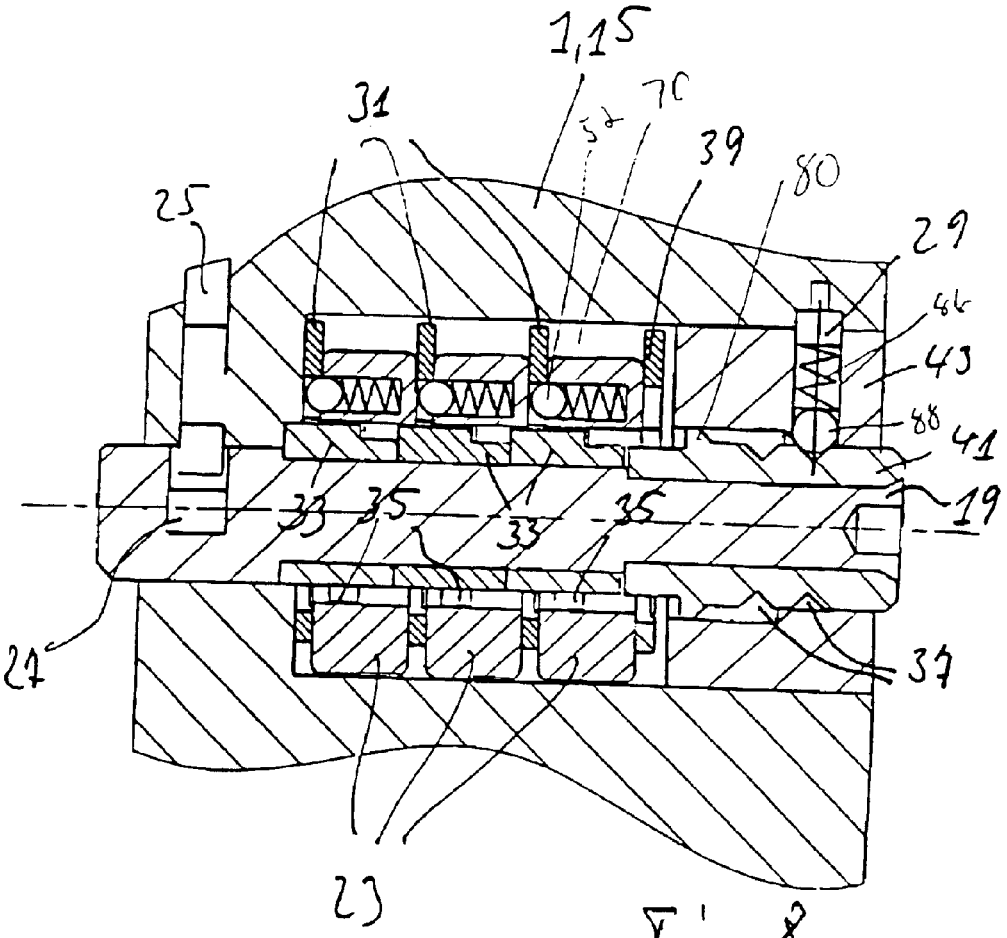
FIG. 8 is a view similar to FIG. 7, but with the combination lock shown in the "safety off" position.

If the pushbutton safety unit (19) is pressed in on the left side until it projects less prominently from the left surface of the transition (15) (see FIG. 8), then the safety unit (19) projects from the right side of the weapon (see FIG. 8) and the weapon is in a safety-off state wherein the weapon may be fired. This state of the combination lock (17) is depicted in FIG. 8. Because of the location of the lock (17), the specifically desired position of the pushbutton safety unit (19) can be felt with the index finger (e.g., the trigger finger), regardless of whether the user of the pistol holds it with his/her right hand or his/her left hand.

Figure 7:
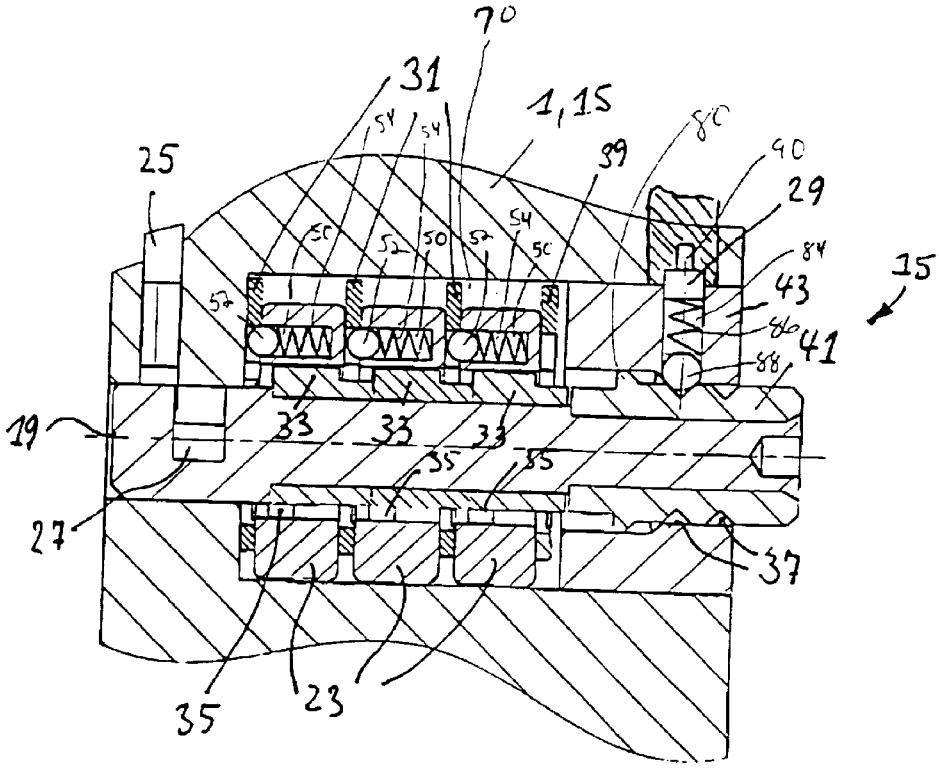
FIG. 7 is a sectional view of the firearm of FIGS. 1–3 through the transition between the trigger guard and the pistol grip and through the combination lock, and showing the lock in the "secure" position.
Figure 9:
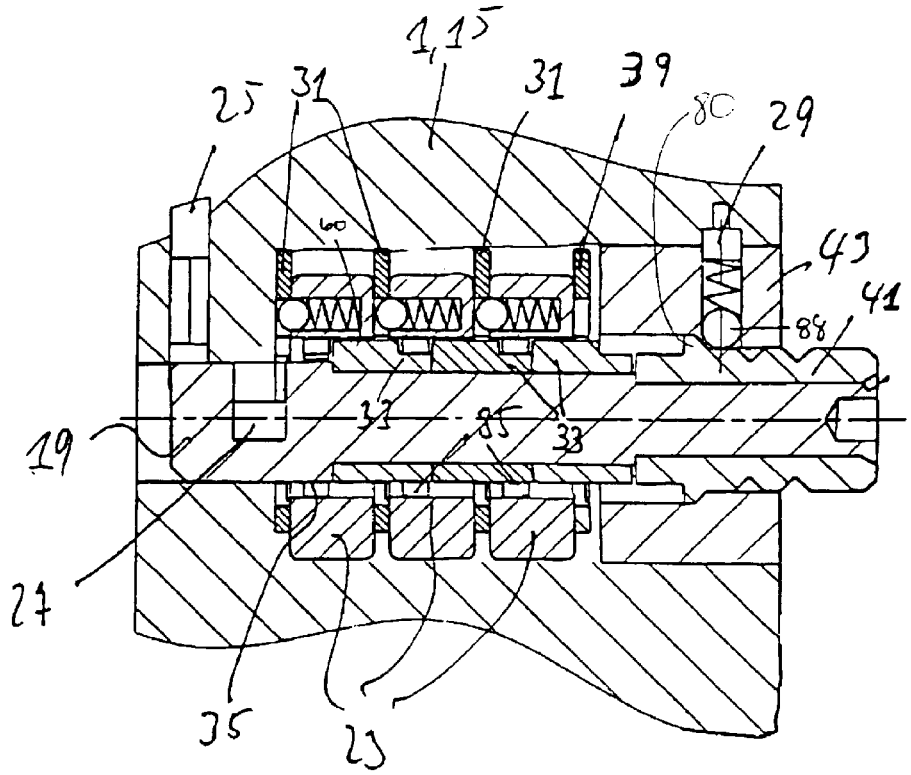
FIG. 9 is a view similar to FIG. 7, but with the combination lock shown in the position for setting the combination.

If, when the combination lock (17) is in a released state wherein the pushbutton unit (19) can be moved from the position of FIG. 7 to the position of FIG. 8, the pushbutton safety unit (19) is pressed from the right side, (e.g., by means of a cartridge tip or other implement), beyond the secured position (FIG. 7) and into an extended position, then a new combination of the number dials (23) required to release the weapon for firing can be set through the aperture (21). This lock setting position of the combination lock (17) is depicted in FIG. 9. If the pushbutton safety unit (19) is again brought into one of the operating positions (FIG. 7 or 8), then the new combination remains valid until another setting occurs (i.e., until the safety unit (19) is again moved to the lock setting position and one or more of the dials (23) are moved to a new position).

FIG. 3 shows that the number dials (23) are not visible to the casual observer. The numerals are placed on the external circumference of the number dials (23). The numerals are oriented in such a direction that, if the numerals have to be viewed (e.g., to adjust the dials) the muzzle of the weapon points away from the user.

The pushbutton (19) additionally has, near its right end, in the interior of the transition (15), a recess or transverse groove (27). When the pushbutton (19) is pushed to the right (i.e., to the safety-off position), the groove (27) aligns with a longitudinal groove that is formed in the grip (1). An extension (25) of the bar, which is connected with the trigger and hammer (7) (see FIGS. 4–6), is positioned for longitudinal movement in this longitudinal groove of the grip (1).

Figure 4:
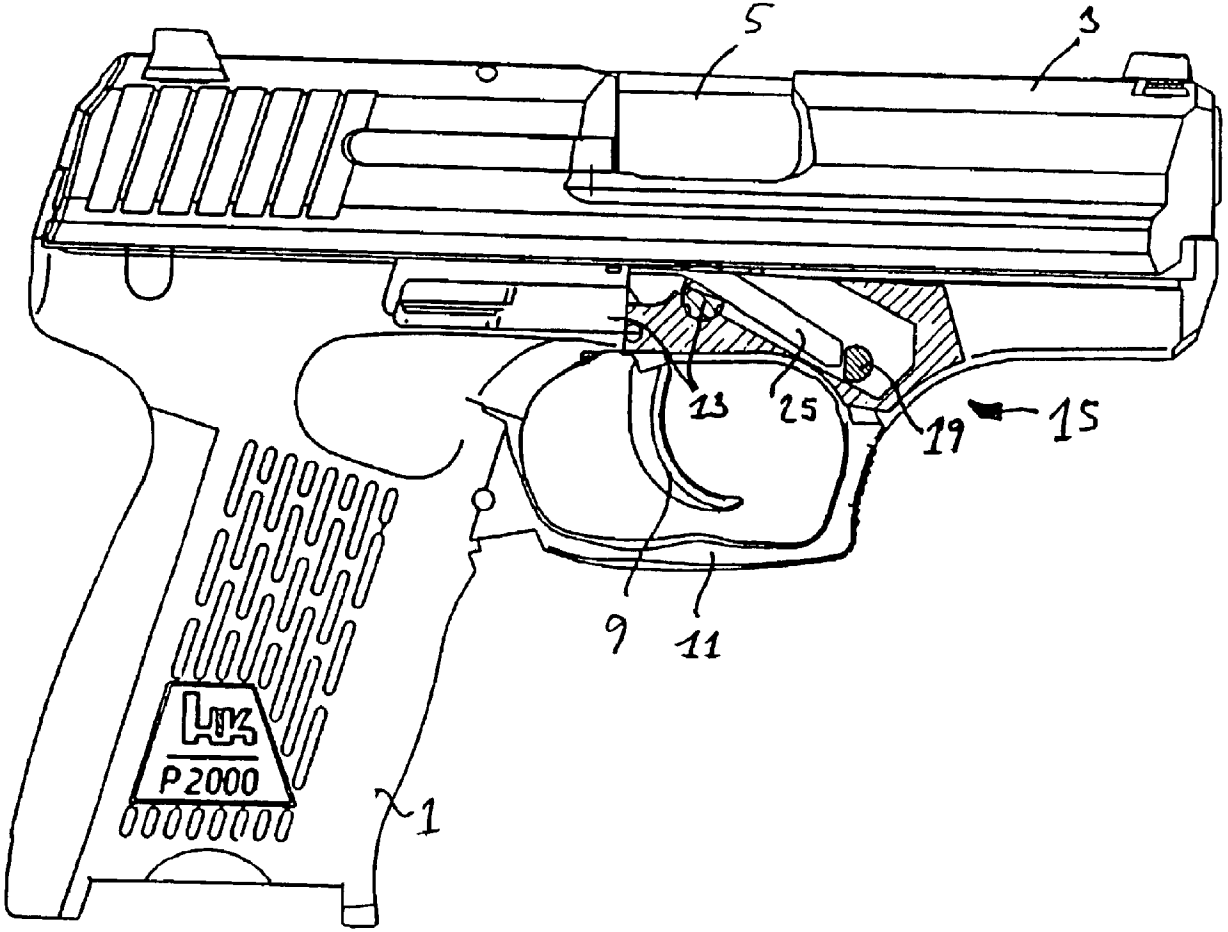
FIG. 4 is a partially cut-away, right side view of the weapon of FIGS. 1–3, viewed from the right, showing the combination lock in the "secure" position.
Figure 5:
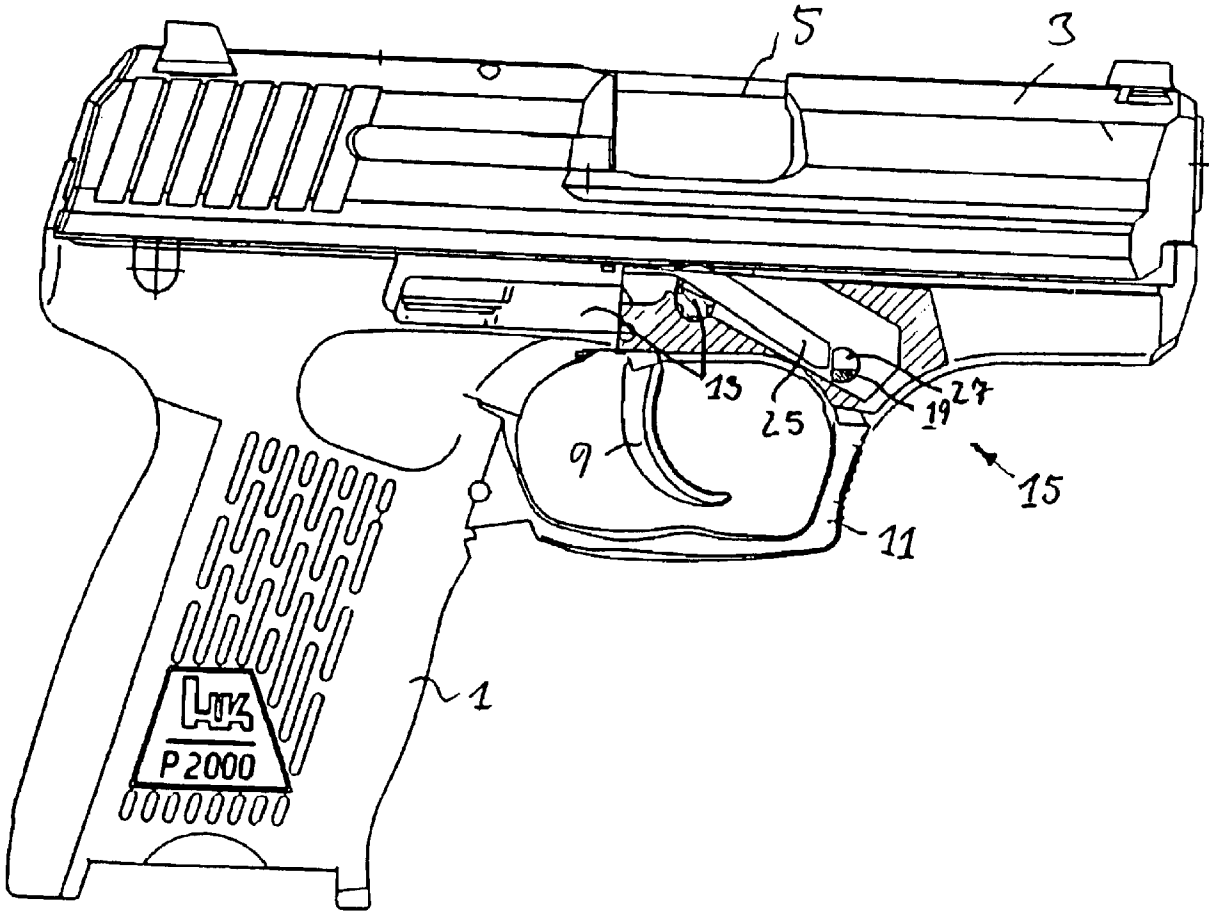
FIG. 5 is a partially cut-away, right side view of the weapon of FIGS. 1–3, viewed from the right, showing the combination lock in the "safety off" position.

This extension (25) of the bar extends from the rear and top toward the front and bottom of the weapon. It also extends transversely to the pushbutton (19). When the trigger (9) is not activated and the hammer (7) is not cocked, this extension (25) is located behind the pushbutton (19) (FIGS. 4 and 5). If the pushbutton safety unit (19) is in the "secure" position (FIG. 7), then the extension (25) of the bar is precluded from moving forward since an attempt to activate the trigger (9) forces the extension (25) against the pushbutton (19). Thus, in this state, the trigger (9) cannot be moved to the rear. Also, the hammer (7), cannot be moved. This blocks the lock (17), so that this lock (17) also cannot be moved.

Figure 6:
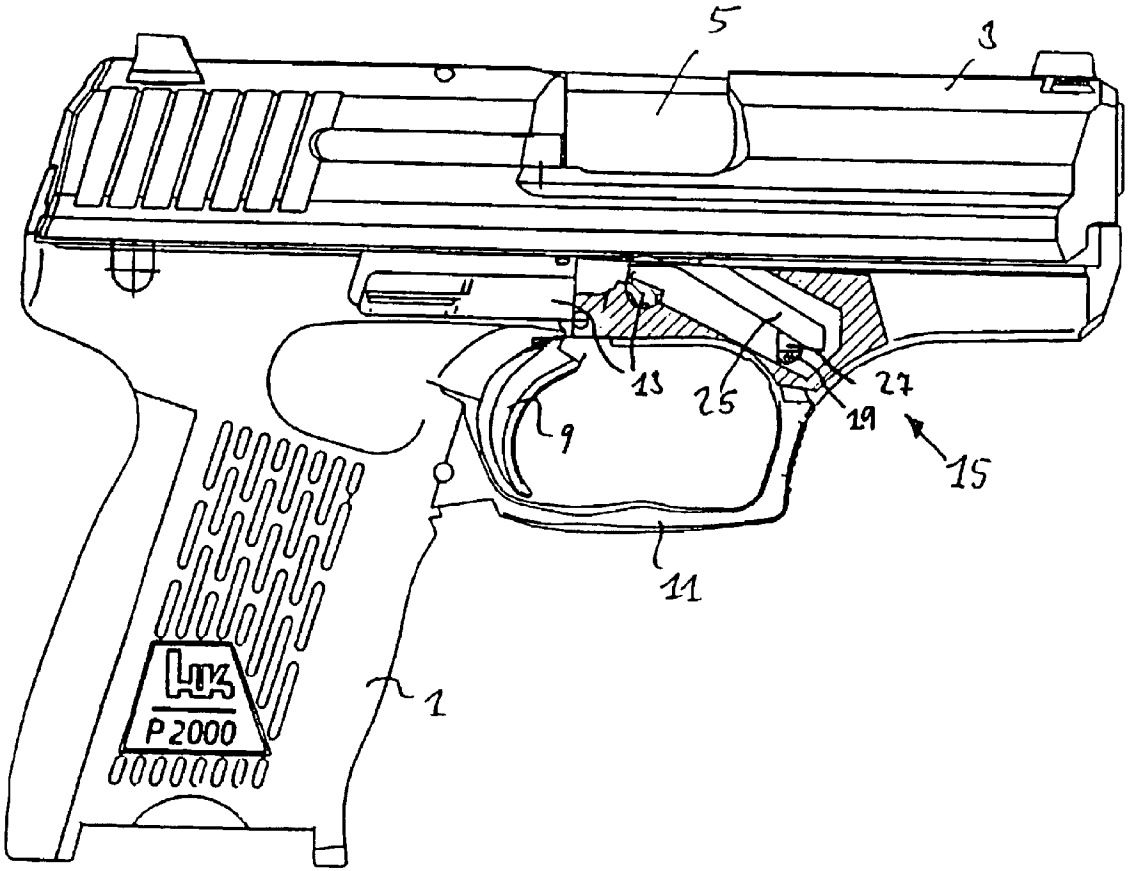
FIG. 6 is a partially cut-away, right side view of the weapon of FIGS. 1–3, shown with the combination lock in the "safety off" position and with the trigger pulled.

The lateral axis of the locking catch device (13) also has a transverse groove (no numerical reference), through which the extension (25) of the bar passes (see FIGS. 4–6). If the trigger (9) is not pulled (FIGS. 4–5), then the extension (25) of the bar blocks movement of the lateral axis of the locking catch device (13) in its longitudinal direction so that the pistol cannot be disassembled.

If the pushbutton (19) is moved into the position of FIG. 8 (the "safety off" position), then the recess (27) is positioned in front of the forward end of the extension (25) of the bar (FIG. 5). The trigger (9) can now be pulled (FIG. 6), because the extension (25) of the bar can move forward into the recess (27). When the extension (25) is so moved, it moves out of the transverse groove (13) of the lateral axis of the locking catch device (13). Consequently, the locking catch device (13) can now be removed, and the firearm can then be further disassembled.

The combination lock (17) depicted in FIGS. 7–9 is shown in a cross-section of the transition (15) from the front of the weapon. The right side of FIGS. 7–9 corresponds to the left side of the weapon, since the sides of the weapon are considered from the rear (i.e., from the viewpoint of the person shooting), and the muzzle points to the front.

The pushbutton (19) forms the axis of the combination lock (17). Starting with the end with the recess (27), three successively-following number dials (23) are positioned for rotation on the pushbutton axis (19). Each of these dials (23) has a ring-like outside rim. The numerals 0 to 9 are formed on the external side of each outside rim. Each of the outside rims defines a blind boring (50) which is open toward the transverse groove (27). Each boring (50) accommodates one catching spring (54) and one catching ball (52). The borings (50) are aligned on the same axis which axis is parallel to the central axis of the pushbutton unit (19). Each outside rim includes ten teeth (35) which are spaced a specific distance apart. The teeth extend radially inward.

A catching plate (31) is fixed, in a non-rotating manner, opposite to each of the catching balls (52). Each of these plates (31) has ten engagement borings (58) formed in a rim-like configuration (see FIG. 7A). If a number dial (23) is rotated, then its catching ball (52) engages a boring (58) in the plate (31) every 36°, such that one numeral is visible in the aperture (21) for each dial (23) (in FIGS. 7–9, this aperture (21) is behind the illustrated plane and, thus, not visible).

The end section of the pushbutton (19) in which the transverse groove (27) is provided has a non-circular cross-section so that the pushbutton (19) cannot rotate. This ensures that the transverse groove (27) is always oriented towards the extension (25) of the bar.

Figure 10:
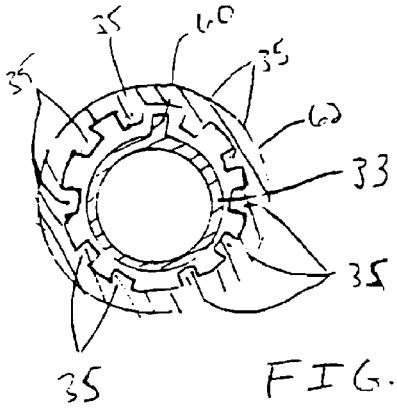
FIG. 10 is a cross-sectional view of a slide bar and a toothing assembly.

Three slide bars (33) are provided on a tapered, cylindrical section of the pushbutton (19). The slide bars (33) have the shape of cylinder liners. As shown schematically in FIG. 10, on the external side of each bar (33), a projection (60) is provided along approximately two thirds of a generating line. As also shown in FIG. 10, an annular toothing assembly (62) is slidably mounted around each of the slide bars (33). Each such toothing assembly (62) includes 10, inwardly directed teeth (35). The teeth (35) of each internal toothing assembly (62) are seated loosely on each of the cylinder liners (33) so that the cylinder liners (33) can be moved along their axis of rotation when, for example, the pushbutton (19) is moved from the position of FIG. 7 to the position of FIG. 9. In the operating positions of FIGS. 7 and 8, the projections (60) penetrate an intermediary space between two teeth (35) of the corresponding internal toothing assembly (62) to prevent relative rotational movement between the liners (33) and the dials (23) carrying the teeth (35).

Figure 7A:
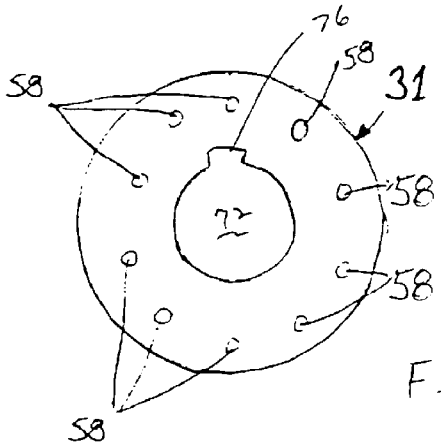
FIG. 7A is a plan view of a catching plate from the lock of FIG. 7.

The external circumferences of the locking disks (31) engage the inner surface of an accommodating boring (70), defined in the transition (15). This engagement centers the disks (31). The disks (31) also each have an inner boring (72) which receives the cylinder liner sections of the slide bars (33). As shown in FIG. 7A, a recess (76) is formed in each disk (31). The recesses (76) of the disks (31) are aligned. The recesses (76) are dimensioned such that the projections (60) of the slide bars (33) pass through the recesses (76) if the slide bars (33) are located in the corresponding rotational position. As shown in FIG. 7, when the projections (60) of the bars (33) are not aligned with the recesses (76) in the disks (31), the slide bars (33) and, thus, the pushbutton (19) cannot be moved transversely relative to the grip (1). As shown in FIGS. 8 and 9, when the projections (60) of the bars (33) are aligned with the recesses (76) in the disks (31), the bars (33) and the pushbutton (19) can be moved transversely relative to the grip (1) between the positions of FIGS. 7, 8 and 9. As shown in FIGS. 9–10, rotating the number dials (23) also rotates the slide bars (33) due to the engagement between the projection (60) and the teeth (35), unless the slide bars (31) are withdrawn with the pushbutton (19) to the position of FIG. 9 wherein the projections (60) are positioned to pass between the teeth (35) to permit setting of a new combination.

An end liner (41) is positioned on the pushbutton (19) opposite the transverse groove (27). The end liner (41) defines two annular grooves (37) and a shoulder (80) oriented towards the number dials (23). The accommodating boring (70) for receiving the combination lock (17) is closed to the outside by means of a sealing liner (43). This liner (43) has a penetrating central boring which is slid up over the cylindrical end of the pushbutton (19). A transverse bore (84) is defined in the liner (43). A compression spring (86) biasing a catching ball (88) radially internally is located in this boring (84). A short blind boring (90), which aligns with the penetrating transverse boring (84), is located in the transition (15). This blind boring (90) forms, together with the body of the lock (17) and the spring (86), a disassembly prevention device (29). After assembly, the body of the lock (17) is seated partially in the penetrating transverse boring (43) and partially in the blind boring (90), and consequently prevents disassembly.

The catching ball (88) is dimensioned to selectively settle into one of the annular grooves (37). The grooves (37) are positioned such that the pushbutton (19) is held in the secured position (FIG. 7) when the ball (88) is in the most inwardly spaced recess (37) and in the safety off position (FIG. 8) when the ball (88) is in the most outwardly located recess (37). A shoulder (80) is inwardly spaced from the more internally-positioned annular groove (37), so that the pushbutton (19) can move still further beyond the safety position until the shoulder (80) almost catches opposite the catching ball (88) (FIG. 9). Note that the central boring of the sealing liner (43) has a section with a smaller diameter than that of the shoulder (80), so that the shoulder (80) cannot be pressed outwardly through the liner (43).

An end plate (39) is located between the first number dial (23) and the adjoining body of the liner (43). This end plate (39) has a central boring (72) and a recess (76), just like the catching disks (31). All of the recesses (76) of the catching plates (31) and the end disk (39) are aligned with one another.

In all but one position, the number dials (23) are in the safety on position. When in the safety on position, at least one of the projections (60) of the slide bars (33) is displaced from (i.e., not aligned with) the adjacent recess (76) of the adjacent plate (31). This displacement can be angularly or in the circumferential direction. When such displacement of any one of the projections (60) occurs, the pushbutton (19) cannot be moved along its longitudinal axis. This position is depicted in FIG. 7, and corresponds to the secured or "safety on" position.

If the number dials (23) are now rotated to the numerical combination that has been set to open the lock (17), then all of the projections (60) align with the corresponding recesses (76) in the catching disks (31) so that the pushbutton (19) can be translated inward to the safety off position of FIG. 8 or forced outward to the combination set position of FIG. 9. The rotation of the slide bars (33) is impossible in the position of FIG. 8, because their projections (60) each engage in a corresponding recess (76) of the adjacent catching disk (31). The number dials (23) also cannot rotate when the lock (17) is in the safety off position of FIG. 8.

If the pushbutton is moved through the safety on position of FIG. 7 and beyond to the set combination position of FIG. 9, then each of the projections (60) of the slide bar (33) not only proceeds out from the recesses (76) of the catching disks (31) they engage in FIG. 8, but also out from the internal teeth (35) of the corresponding number dial (23). When the pushbutton (19) reaches the position of FIG. 9, each of the projections (60) enter the recess (76) of the corresponding adjacent catching disk (31) or of the end plate (39). The slide bars (33) are, thus, secured against rotation, but the number dials (23) can be rotated as desired. When a new combination is set by rotating the dial(s) (23) relative to the slide bar(s) (33), the new combination is visible in the aperture (21). The pushbutton (19) is then pushed in again until the ball (88) engages in one of the two annular grooves (37) (FIG. 7 or FIG. 8). The projection (60) of each slide bar (33) enters into the corresponding internal teeth (35) of their respective number dial (23) again, so that the projections (60) and teeth (35) are connected with one another in a new angular position which does not permit relative rotation displacement therebetween.

From the foregoing, persons of ordinary skill in the art will appreciate that a hand-held firearm has been provided which includes a combination lock (17). The lock (17) makes possible a secure handling of the hand-held firearm, is inconspicuous, and does not unreasonably disfigure the weapon. The illustrated combination lock (17) is easily accessible, but is positioned discreetly and without impairing the weapon's appearance. An economical production of the illustrated weapon is possible.

As used herein, the term "combination lock" refers to a device with at least one rotatable dial which has a number of symbols distributed over its circumference. These symbols are referred to throughout this patent as "numerals" for the sake of simplicity, but they can also be logos or the like. To release the lock (17), the number dials (23) can be rotated, by means of a finger or a pointed object (such as of a ballpoint pen, for example) such that a desired numeral or group of numerals corresponding to the combination is visible through the aperture (21). Catch units (52, 54, 58) facilitate positioning of the number dial(s) (23).

In the illustrated example, the axes of the number dials (23) are horizontally oriented, transversely to the longitudinal axis of the weapon. The combination lock (17) is located in front of the trigger (9) within the transition (15) near the trigger guard (11).

In a whole series of known firearms, a pressure safety device, such as a safety bolt, passes horizontally through the transition between the trigger guard and the casing in the transverse direction and projects from the right side or the left side of the transition, depending on whether it has been secured. In these weapons, the transition (15) must only be slightly expanded in order to accommodate the combination lock (17) disclosed herein—rather than a known safety bolt—. The diameter of the illustrated lock (17) exceeds that of the known safety bolt.

In a self-loading firearm, the impression of a bulky transition can be reduced still further through a deeper positioning of the lower edge of the forward part of the grip (1), in comparison with a conventional self-loading firearm, so that the observer does not have the feeling that something as bulky as the combination lock (17) is concealed within this part of the weapon.

The combination lock (17) can have any desired number of dials (23) and each number dial (23) can have any number of numerals, within reason. The more numerals that are present, however, the greater is the diameter of the combination lock (17). The more number dials (23) that are present, the longer the combination lock (17) must be. In order to ensure the quantity of possible lock combinations is not too small, at least three number dials (23) are preferably provided, each of which preferably has 10 numerals. The number of combinations arising from this approach is large enough to make it difficult to guess the combination. Any number between 000 and 999 can be chosen as a combination. If the combination lock (17) can be set by the user himself, it can be set to, for example, the last three digits of his personal identification number (PIN). The user can set the combination to a number between 000 and 999 which he/she can easily reproduce again if he/she should forget it.

The number dials (23) can be substantially exposed. A marking then designates the point at which the combination is to be set. Preferably, however, only a relatively small aperture (21) through which the combination is visible and can be adjusted (such as by means of the fingernail or a pointed object), is provided.

The combination to be set could be visible in an aperture of the transition (15) oriented towards the front. This approach would have the advantage of easy visibility and adjustability. However, it is particularly advantageous to place the aperture (21) inside the trigger guard (11) in such a manner that it points to the rear and is oriented towards the trigger (9). This orientation of the aperture has the advantage that the user does not have to look in the direction of the muzzle upon considering and setting the combination of the lock (17). It also has the further advantage that the number dials (23) will typically not be accidentally moved upon rummaging around in the pocket in which the weapon is carried. It is also an advantage that the combination of numbers is only visible at a discreet and inconspicuous point, so that the causal observer will not even note that it is a weapon with a safety lock.

As discussed above, one of the main disadvantages of the prior art machine pistols with a combination lock described above is the fact that the person shooting can—in the event of darkness, for example—only determine whether the combination lock is blocked or will fire a shot by pulling the trigger. In contrast, the firearm disclosed herein provides a physical indication by means of which the user can determine the condition of the combination lock (17) (i.e., blocked or open). By means of this physical indication (e.g., a signaling pin), the shooter can determine the condition of the combination lock (17) even if he/she has no possibility of convincing himself/herself whether the correct combination is set by glancing at the numbers. Consequently, the readiness of the weapon to be fired can be checked safely, even in the dark.

Preferably, a safety device (e.g., pushbutton (19), as an operating lever, an activating button, or the like) is provided. The position of the safety device (safety on, or ready to fire) can be physically sensed by the operator. In this approach, the combination lock (17) secures the safety device (e.g., pushbutton (19)) against movement unless the correct combination is dialed in. The lock (17), thus, does not act directly upon the trigger bar, but instead acts on the safety device which in turn acts on the trigger bar or an intermediary for the trigger bar. If the safety device is in the "fire" position (i.e., the safety off position), then the combination lock (17) must necessarily be open now. If the safety device is in the "secure" position (i.e., the safety on position) and cannot be moved into the "fire" position, then the combination lock (17) is locked. If the shooter wants to determine the condition of the combination lock (17), then he/she only needs to operate the safety device, which he can safely do without risk of firing a shot.

If the user is about to lose the weapon (e.g., in a street scuffle), then he/she can still possibly move the safety device into the "secure" position, so that the weapon cannot be immediately fired by the opponent. An activation element which, upon securing the safety device (19), adjusts the number dials (23) so that the weapon cannot be moved to the safety-off position until the combination of numbers on the dials (23) is again adjusted, may be connected with the safety device for this purpose.

The safety device (19) is preferably configured as a pressure safety device which is formed as the axis of the combination lock (17). Using a pressure safety device at the point of the transition (15) is already known. However, unlike prior safety devices, the secured pressure safety device disclosed herein can only be pressed if the combination of the combination lock (17) is entered. If the pressure safety device (19) has been pressed in and, therefore, the safety is removed, then the illustrated combination lock (17) cannot be adjusted. Even if the number dials (23) should be acted on (such as by the trigger finger of the user, for example), they cannot be adjusted, so that the weapon disclosed herein remains reliably ready to fire. That is to say, the disclosed weapon remains reliably usable in the event of an emergency.

In a modem self-loading firearm, including a safety device at the transition is extremely unusual so that, even if an opponent does seize the weapon in a street scuffle, he/she will not quickly discover the pressure safety device without a prior careful examination of the weapon.

The combination lock of the prior art machine pistol stated above has a fixed combination. Therefore, if the weapon is ever temporarily entrusted to another person for use or resold as a used weapon, then the danger exists that the fixed combination of numbers will become known to many persons. Moreover, since the combination is fixed by the manufacturer it typically can only be remembered with difficulty and cannot be reconstructed in the event of being forgotten.

In contrast, the combination lock (17) of the device disclosed herein has an adjustable combination. Such numerical locks are known (such as in briefcases) and can, for example, be set after opening by pressing on the axis for any new combination of numerals. If the axis is moved into its operating position again, then the combination lock remains set on the new combination of numerals. This can only be changed by a renewed pressing on the axis.

Such a re-setting possibility is also preferred in the disclosed firearm. In particular, the axis of the combination lock (17) is designed as a pressure safety device (19). This axis closes, in each of its end positions, quite snugly with the outside surface of the casing or grip (1) of the weapon, as is usual in a pressure safety device. By means of a tool, however (e.g., a cartridge), the axis can be pressed beyond one of the end positions when the combination lock (17) is opened, and into a combination setting position. The adjustment can be carried out by rotating the number dials (23) to the new combination when the pushbutton (19) is in this combination setting position.

As a result, the combination lock (17) of the weapon can be individually set for every user. Each user then select a combination of numerals which is known to him/her and which possibly will not be forgotten after the passage of years. It is also possible that after transferring the weapon to another person, that this second person can set a new combination known only to himself/herself. The combination of numerals should not be recorded, such as on a card that is stored on the weapon, for example, because, in such a case, an unauthorized person could, upon stealing the weapon, also obtain the combination of numerals at the same time.

The combination lock (17) preferably has a disassembly prevention device which makes at least an unintentional disassembly of the combination lock (17) impossible. A damaging of the casing or grip (1) should be anticipated if an attempt is made to break the combination lock (17) out of the weapon. The combination lock (17) is, thus, secured against removal.

If the casing or grip (1) is made from plastic, the disassembly prevention device cooperates with a reinforcement of metal, preferably of steel or hard metal, which is set in the plastic. Thus, the surface pressures that appear upon a forcible striking of the combination lock (17) are conveyed onto a large surface, so that the plastic can withstand these stresses.

In an additional configuration, the weapon can neither be disassembled, nor opened or reloaded, when the combination lock (17) is locked. The bar or its extension (25) passes through the transverse bolt, for example, which, in the Colt-Browning construction, must be removed before disassembling the weapon, so that this transverse bolt can only be removed if the trigger (9) has been pulled. This is only possible, in turn, if the combination lock (17) has been opened. In this way, an unauthorized person is prevented from being able to remove important parts (e.g., barrel, lock) if the combination lock (17) has been secured.

The hand-held firearm disclosed herein can, for example, be a self-loading pistol, such as one with a plastic pistol grip and/or one that has a hammer lock with double movement (i.e., double-action hammer lock).

In such a weapon, the trigger (9) is connected solidly with the hammer (7), when the weapon is in the safety on state. That is to say, upon pulling back the hammer (7), the trigger (9) must also be moved to the rear. If this trigger movement is impeded by the combination lock (17), then the hammer (7) also cannot be moved backwards. This has the result that the weapon can (in the case of a self-loading pistol of the Colt-Browning construction) not be disassembled. The weapon secured with the combination lock (17) cannot, therefore, be reloaded. It can also not be loaded by an unauthorized person in secret, which could, for example, then lead to an accident if the authorized person—being convinced that the weapon is not loaded—were to carry out a pulling motion after removing the safety of the combination lock (17).

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What claimed is:

1. A hand-held firearm having a longitudinal axis comprising:

a trigger which is at least partially surrounded by a trigger guard;

a trigger bar operatively connected to the trigger;

a combination lock having an axis and a number dial, the lock operatively engaging the trigger bar to preclude movement of the trigger bar when the lock is in a locked state and to permit movement of the trigger bar when the lock is in an unlocked state, the axis of the lock being positioned in front of the trigger in a generally horizontal plane and transversely to the longitudinal axis of the hand-held firearm; and an aperture located inside the trigger guard and opposite to the trigger to provide access to the number dial.

2. A hand-held firearm as defined in claim 1, wherein the number dial comprises at least three number dials.

3. A hand-held firearm as defined in claim 1, wherein the number dial bears ten numerals.

4. A hand-held firearm as defined in claim 1, further comprising an indicator to physically indicate whether the combination lock is in the locked state or the unlocked state.

5. A hand-held, firearm as defined in claim 4, wherein the indicator is a movable safety device having a release position and a safety position, wherein the indicator cooperates with the lock to prevent movement of the trigger bar when the lock is in the locked position and the safety device is in the safety position and to permit movement of the trigger bar when the lock is unlocked and the safety device is in the release position, and wherein the safety device can only be moved into the release position if the lock is in the unlocked state.

6. A hand-held firearm as defined in claim 5, wherein the indicator is a pushbutton forming the axis of the combination lock.

7. A hand-held firearm as defined in claim 1, wherein the combination lock has an adjustable combination.

8. A hand-held firearm as defined in claim 7, wherein the lock is movable along its axis between a first position, a second position and a third position when the lock is in the opened state, and wherein the combination can be adjusted when the lock is in the third position.

9. A hand-held firearm having a longitudinal axis comprising:

a trigger which is at least partially surrounded by a trigger guard;

a trigger bar operatively connected to the trigger;

a combination lock having an axis and a number dial, the lock operatively engaging the trigger bar to preclude movement of the trigger bar when the lock is in a locked state and to permit movement of the trigger bar when the lock is in an unlocked state, the axis of the lock being positioned in front of the trigger in a generally horizontal plane and transversely to the longitudinal axis of the hand-held firearm; and a disassembly prevention device associated with the combination lock, wherein the disassembly prevention device cooperates with a metallic reinforcement located in a casing of the firearm.

10. A hand-held firearm defined in claim 9, wherein the firearm cannot be opened when the combination lock is in the locked state.

11. A hand-held firearm as defined in claim 9, wherein the firearm cannot be disassembled when the combination lock is in the locked state.

12. A hand-held firearm having a longitudinal axis comprising:

a housing;

a trigger; and a combination lock having a longitudinal axis positioned transversely to the longitudinal axis of the firearm, wherein the lock includes a plurality of dials, wherein the housing defines an aperture in front of, and facing, the trigger, and wherein the dials display a combination of symbols through the aperture.

13. A firearm as defined in claim 12 wherein the symbols are numbers.

14. A firearm comprising:

a trigger, a housing defining an aperture in front of, and facing, the trigger; and a combination lock having a plurality of dials which display a combination of symbols through the aperture.

15. A firearm as defined in claim 14 wherein the symbols are numbers.

16. A firearm comprising:

a housing;

a trigger; and a combination lock having an axis, the lock having a locked state wherein the lock substantially precludes movement of the trigger and an unlocked state wherein the lock permits movement of the trigger to fire a shot, the lock being axially movable relative to the housing when the lock is in the unlocked state, wherein the lock includes a plurality of dials, wherein the housing defines an aperture in front of, and facing, the trigger, and wherein the dials display a combination of symbols through the aperture.

17. A firearm as defined in claim 16 wherein the lock has a combination, a first axial position, a second axial position and a third axial position, wherein the combination is adjustable when the lock is in the first axial position, and wherein the lock can only be in the second axial position when the lock is in the locked state.

18. A firearm as defined in claim 16 wherein the position of the lock relative to the housing indicates if the lock is securing the firearm against shooting.

* * * * *